United States Patent [19]

Harris

[11] 4,020,822

[45] May 3, 1977

[54] MULTI-FUEL FORCED AIR FURNACE

[75] Inventor: Harold F. Harris, Oneida, N.Y.

[73] Assignee: Oneida Heater Company, Incorporated (Entire), Oneida, N.Y.

[22] Filed: Sept. 19, 1975

[21] Appl. No.: 614,956

[52] U.S. Cl. ..... 126/110 R; 126/112; 126/116 R

[51] Int. Cl.[2] ..... F24H 3/02

[58] Field of Search ..... 126/110 R, 110 B, 116 R, 126/112, 106, 99 R

[56] References Cited

UNITED STATES PATENTS

| | | | |
|---|---|---|---|
| 925,570 | 6/1909 | Eckert | 126/12 |
| 2,057,033 | 10/1936 | Kelly | 126/110 R |
| 2,073,424 | 3/1937 | Fay | 126/110 R |
| 2,121,108 | 6/1938 | Tuck | 126/110 R |
| 2,135,547 | 11/1938 | Warr | 126/110 R |
| 2,291,145 | 7/1942 | Buck | 126/110 R |
| 2,345,559 | 4/1944 | Fraser | 126/110 R |

*Primary Examiner*—Paul E. Maslousky
*Attorney, Agent, or Firm*—Clarence A. O'Brien; Harvey B. Jacobson

[57] ABSTRACT

Solid fuel supported on a grate within the combustion chamber of a furnace, is ignited by a liquid or gas fuel burner projecting its flame entirely within the same combustion chamber. A forced inflow of air is preheated by being conducted below and in surrounding relation to the combustion chamber and then passed in heat exchange relation to heat transfer ducts through which combustion products are conducted from the combustion chamber.

21 Claims, 16 Drawing Figures

MULTI-FUEL FORCED AIR FURNACE

BACKGROUND OF THE INVENTION

This invention relates to air heating furnaces and more particularly to a forced air-type of furnace adapted for home heating purposes.

Generally, forced air heating furnaces installed in private homes and residences, are limited in use to a single type of fuel whether it be a coal or wood fired furnace or a fluid fuel burning furnace utilizing a liquid or gaseous fuel. While liquid or oil and gas fired furnaces have been generally adopted in recent years as the central air heating plant for homes and residences, the more current energy problems and fuel shortages have induced builders to look toward other types of furnaces capable of being fired by solid fuels that are more plentiful. Because of the uncertainties that have arisen with respect to the availability and cost of fluid and solid fuels, it would be desirable to provide a central heating furnace that is capable of being fired by either or both types of fuels.

Fuel fired heating plants capable of utilizing either fluid or solid fuels, have heretofore been proposed as disclosed, for example, in U.S. Pat. Nos. 1,113,379, 1,508,393, 1,840,306, 2,848,958 and 3,066,655. Usually, such prior fuel fired heating plants either embody separate combustion chambers for the different types of fuel or require a substantial change over procedure to convert it from one type of fuel fired heating plant to another type of fuel fired heating plant. It is therefore an important object of the present invention to provide a fuel fired heating plant of the forced air type employing a single combustion chamber within which both fluid and solid fuels including wood may be burned.

An additional object in accordance with the foregoing object is to provide a heating plant that requires no structural change or change over procedure in order to convert it from a fluid burning furnace to a solid fuel burning furnace, with both types of fuels capable of being burned simultaneously.

Yet another object of the present invention is to provide a central heating plant of the forced air type wherein a fluid fuel burner is utilized for ignition of a solid fuel with burning of both fuels occurring within a common combustion chamber in an efficient manner with facilities for handling either type of fuels.

SUMMARY OF THE INVENTION

In accordance with the present invention, an outer insulated enclosure encloses a combustion chamber and forms vertical duct passages thereabout into which a forced flow of air is induced by a blower. The vertical duct passages surrounding the combustion chamber are in fluid communication with a converging passage through which the forced air flow is conducted below the combustion chamber in order to vary the flow rate of air at different locations about the combustion chamber producing a uniform cooling of the combustion chamber walls and a corresponding preheating of the air which rises to the top of the insulated enclosure within which the air is heated by a heat exchanger arrangement before the heated air is discharged into duct work for zone heating purposes. Combustion products from the combustion chamber are conducted into the heat exchanger which includes at least two horizontal conduits through which the combustion products are conducted in reverse directions transversely of the vertical duct passages through which the air rises to the upper outlet of the furnace.

A grate assembly is mounted within the combustion chamber for support of solid fuels such as coal and wood logs as the primary fuel, a shaker mechanism being associated with the grate assembly in order to enhance the collection of combustion residues within an ash pan collector positioned below the combustion chamber by an inclined support which forms the bottom converging passage aforementioned into which a forced inflow of air is conducted. The front wall of the outer enclosure mounts separate access doors through which the solid fuel is loaded and the ash pen collector is removed or reinserted. A liquid fuel or gas burner is mounted on the front wall of the outer enclosure vertically between the access doors and includes a firing tube which projects into the combustion chamber. The burner is rendered operative to ignite the solid fuel by means of a flame issuing across the grate assembly toward the rear wall of the combustion chamber located adjacent to the blower module. The liquid or gas burner may be automatically shut down under temperature control when burning of the solid fuel has progressed to a point sufficient to provide the requisite heat output. Alternatively, the liquid or gas fuel burner may be operated continuously in the absence of any solid fuel within the furnace. Thus, conversion of the furnace between fluid fuel and solid fuel burning operations may be effected automatically or semi-automatically in order to permit use of any type of fuels such as oil, gas, coal and wood in the form of logs.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
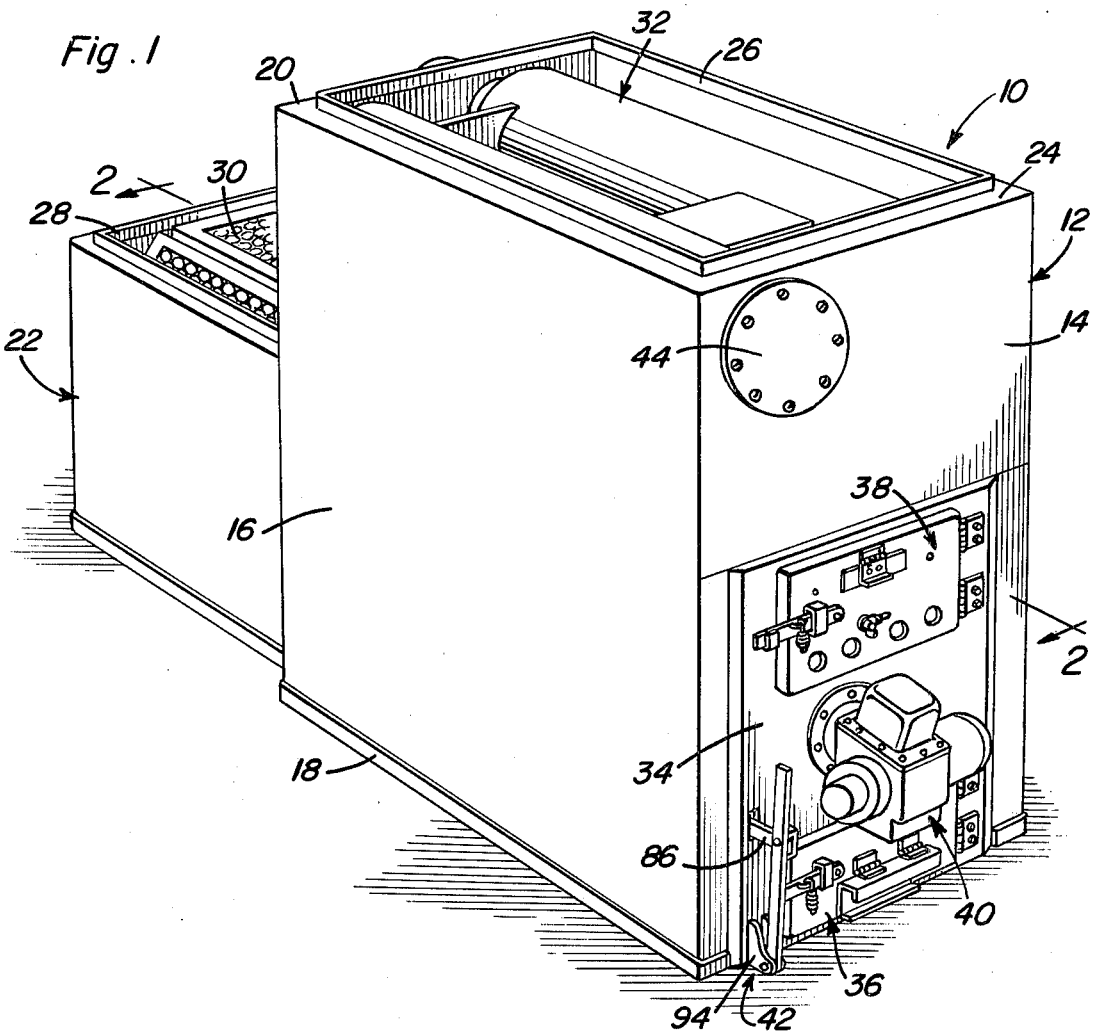
FIG. 1 is a perspective view illustrating a central heating plant furnace constructed in accordance with the present invention.
Figure 13:
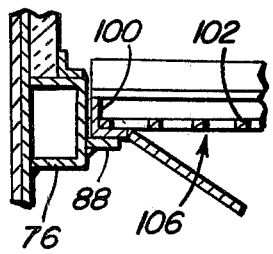
FIG. 13 is a partial sectional view similar to FIG. 9 but showing installation of the grate assembly illustrated in FIGS. 10–11.

Referring now to the drawings in detail, FIG. 1 illustrates a central heating plant constructed in accordance with the present invention and generally referred to by reference numeral 10. The heating plant is of the forced air furnace type and includes an outer insulated enclosure generally referred to by reference numeral 12 having a front wall 14, parallel spaced side walls 16, a bottom base 18 and a rear wall 20 to which a blower module 22 is connected. A top wall 24 of the enclosure 12 is provided with an air outlet opening 26 to which the duct work is connected for conducting heated air to various zones within a building to be heated. Air is drawn into the heating plant by the blower module 22 through a top inlet opening 28. The air drawn in is conducted through an arrangement of filters 30. As will be explained hereafter, the air drawn in is initially preheated and then heated to its outflow temperature by a heat exchanger arrangement generally referred to by reference numeral 32 located within the insulated enclosure 12 adjacent to the top opening 26.

With continued reference to FIG. 1, the front wall 14 of the enclosure 12 is provided with a mounting panel 34 that extends upwardly from the base 18. Mounted adjacent the bottom of the panel 34 is an ash pit access door generally referred to by reference numeral 36. A feed door generally referred to by reference numeral 38 is mounted adjacent the upper edge of the panel 34. Also mounted on the panel vertically between the doors 36 and 38, is a high pressure oil fired or gas fired burner assembly generally referred to by reference numeral 40. The panel 34 also mounts a manually operable shaker mechanism 42 adjacent one vertical side thereof. Also located on the front wall 14 adjacent the upper end is an opening sealingly closed by a cleanout cover 44.

Figures 2, 9:
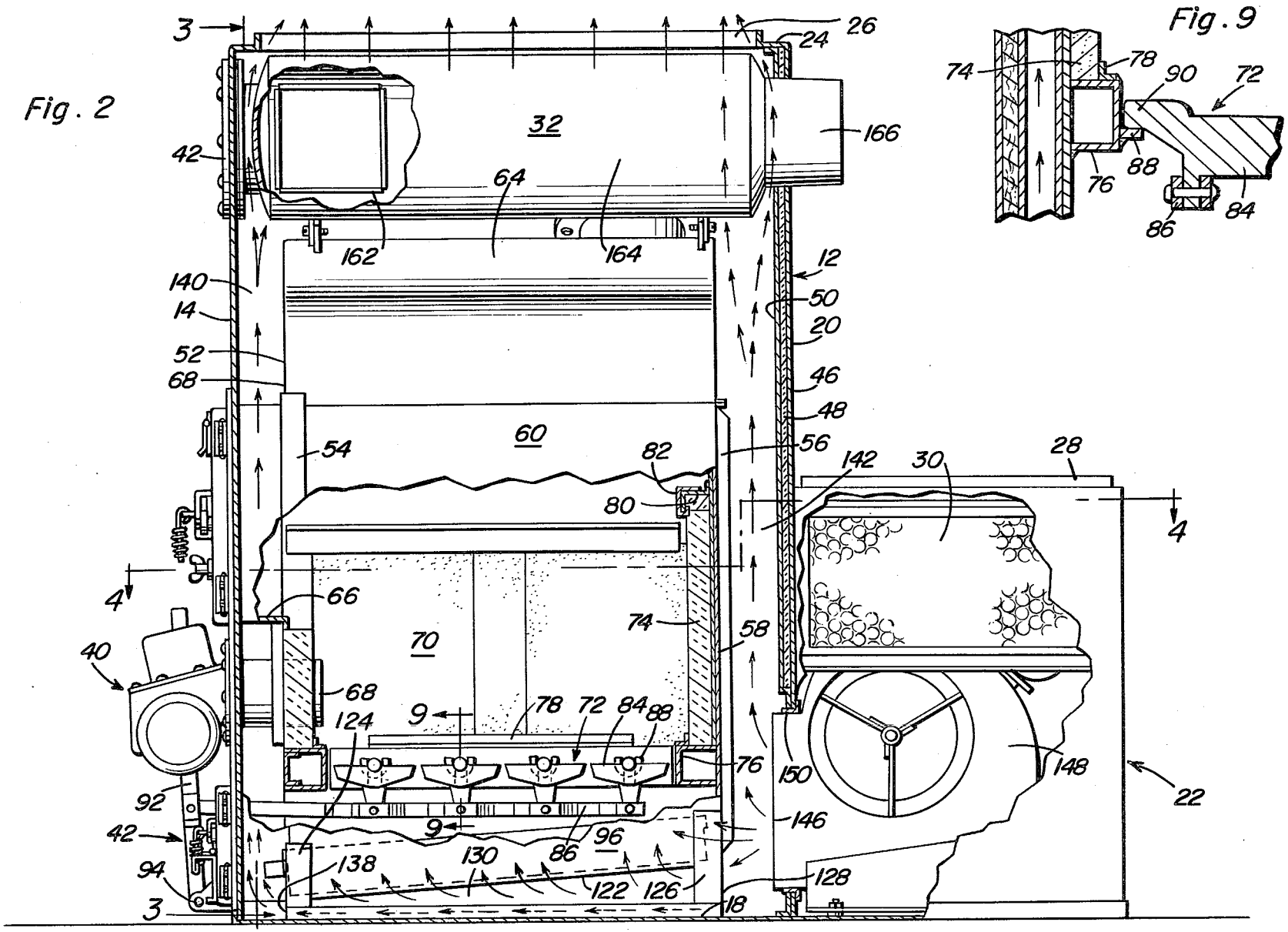
FIG. 2 is a side sectional view taken substantially through a plane indicated by section line 2—2 in FIG. 1 with parts broken away and shown in section.
FIG. 9 is an enlarged partial sectional view taken substantially through a plane indicated by section line 9—9 in FIG. 2 showing a portion of the grate assembly.
Figure 3:
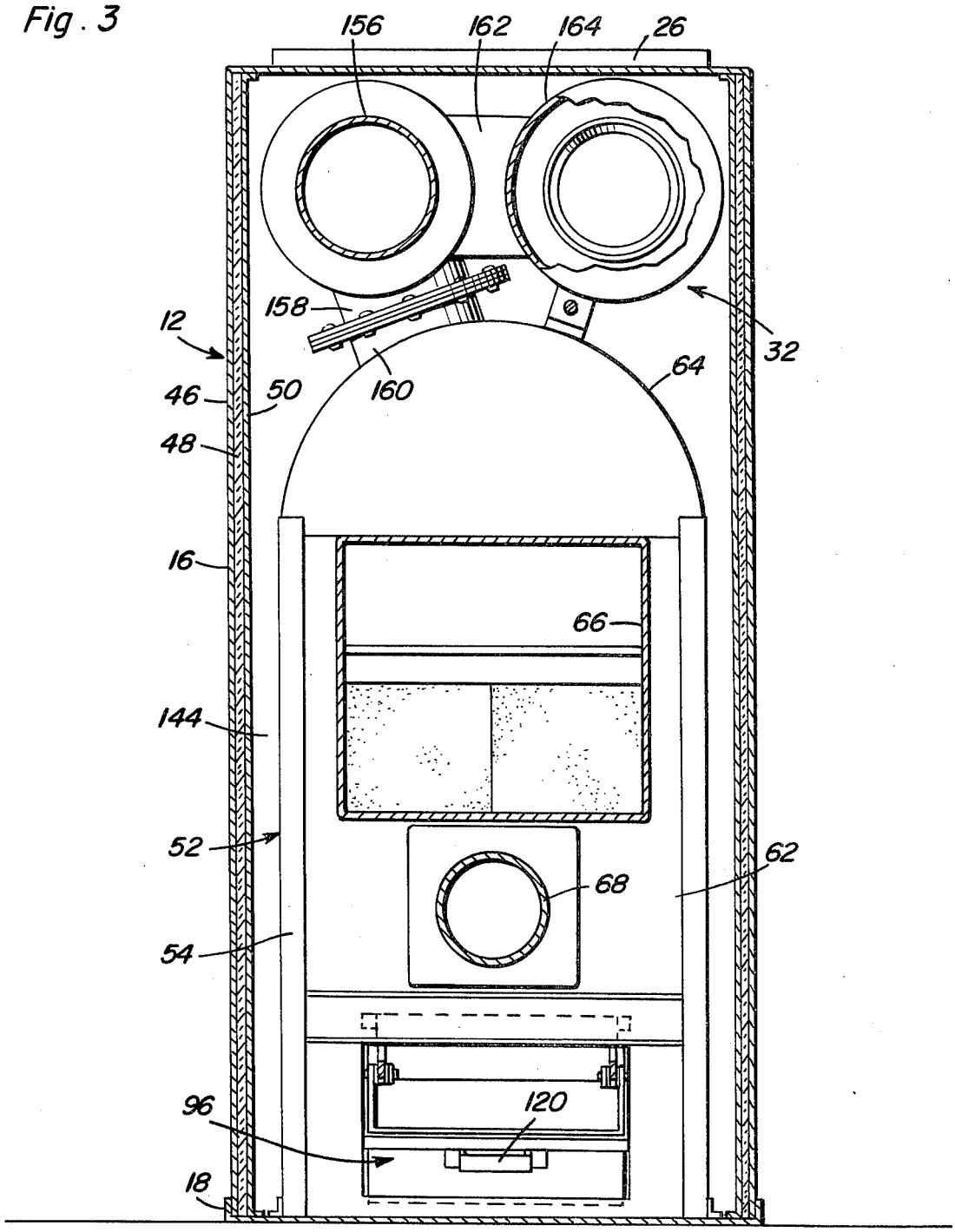
FIG. 3 is a front sectional view taken substantially through a plane indicated by section line 3—3 in FIG. 2.
Figures 4, 10, 11, 12:
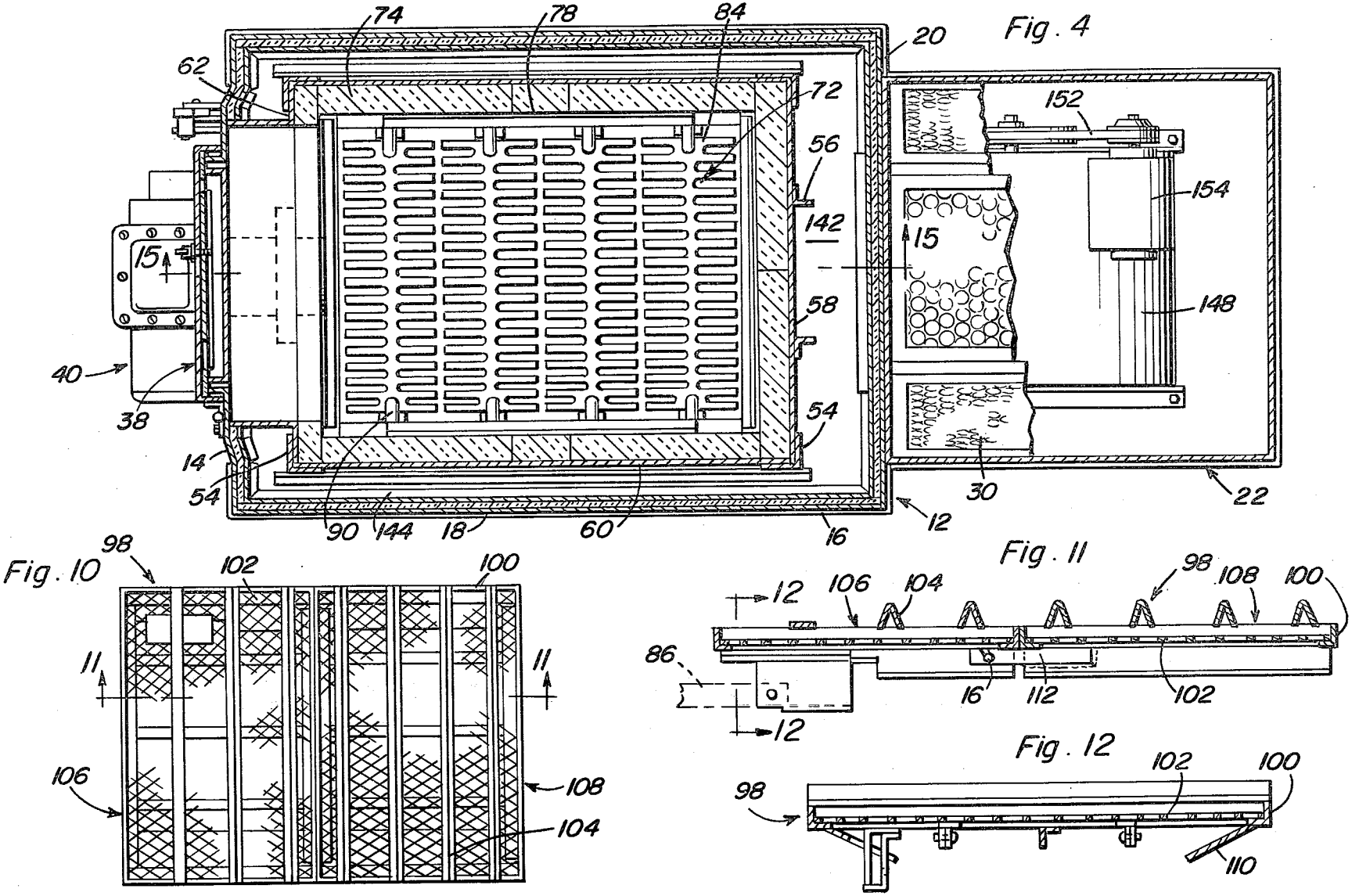
FIG. 4 is a top sectional view taken substantially through a plane indicated by section line 4—4 in FIG. 2.
FIG. 10 is a top plan view of another form of grate assembly capable of being utilized in the furnace.
FIG. 11 is a side sectional view taken substantially through a plane indicated by section line 11—11 in FIG. 10.
FIG. 12 is a sectional view taken substantially through a plane indicated by section line 12—12 in FIG. 11.

Referring now to FIGS. 2, 3 and 4, the walls of the enclosure 12 include a baked enamel exterior sheet metal portion 46 lined with a layer of insulation 48 such as fiber glass or corrugated asbestos and interior reflective sheets of foil lining 50. Vertically positioned on the base 18 of the enclosure in spaced relation to the vertical walls 14, 16 and 20 of the enclosure is a fuel burning heat generator generally referred to by reference numeral 52. The heat generator is vertically positioned in spaced relation to the walls of the enclosure by means of vertical corner posts 54 made of right angle sections that are secured to the bottom base 18. Additional angle iron braces 56 are secured to the rear wall 58 of the heat generator facing the blower module 22 as more clearly seen in FIGS. 3 and 4. The rear wall 58 is interconnected with parallel spaced side wall 60, the side walls being interconnected by a front wall 62. The top of the heat generator is closed by a semi-cylindrical roof portion 64 spaced below and interconnected with the heat exchanger 32. As more clearly seen in FIGS. 3 and 4, the front wall 62 of the heat generator is provided with an opening to which rectangular infeed section 66 is connected above the burner assembly 40, the infeed section 66 extending between the heat generator and the front wall 14 of the outer enclosure 12. Solid fuel is adapted to be loaded into the heat generator through the infeed section 66 and an opening formed in the front wall upon opening of the feed door 38. Also extending from the fuel burner assembly 40 into the heat generator is a firing tube 68. As more clearly seen in FIGS. 2 and 3, the firing tube 68 projects from the front wall of the enclosure into a combustion chamber 70 formed within the heat generator.

The combustion chamber 70 is formed between the front and rear walls 62 and 58 and the side walls 60 of the heat generator above a grate assembly generally referred to by reference numeral 72 on which the solid fuel such as coal is supported. The combustion zone or chamber is lined with brick 74 supported on a channel frame 76 secured to the inside of the front, rear and side walls. The channel frame 76 also surrounds the grate assembly 72 and mounts brick retaining angle iron ssections 78 to hold the brick against the inside of the heat generator walls. The upper edge portions of the brick are held against the inside of the walls by retainer sections 80 the surfaces of which are protected by a lining or sleeve 82 as more clearly seen in FIG. 2.

The grate assembly 72 encircled by the channel frame 76, includes a plurality of grate sections 84 pivotally interconnected with a connecting link 86. The grate sections 84 are pivotally supported on the channel frame 76 by means of U-shaped bearings 88 receiving the trunnions 90 projecting from each end of a grate section 84. The U-shaped bearings 88 are secured to the channel frame 76 as more clearly seen in FIG. 9, thereby permitting each grate section to be simply lifted upwardly for removal purposes. The connecting link 86 to which each of the grate sections is pivotally interconnected, extends forwardly from the heat generator below the channel frame 76 and out through an opening in the front panel 34 of the outer enclosure. The forward end of the connecting link 86 is pivotally connected to a shaker arm 92 which is pivotally connected at its lower end to a clevis pivot bracket 94 associated with the shaker mechanism 42. By means of the shaker mechanism, combustion residue or ash accumulated on the grate assembly may be deposited into an ash collection pan 96 located below the grate assembly as more clearly seen in FIG. 2.

FIGS. 10, 11 and 12 illustrate another form of grate assembly generally referred to be reference numeral 98 which is particularly suitable for supporting logs. The grate assembly includes a peripheral frame 100 made of angle iron supporting a diamond-shaped grid 102. Parallel spaced bracing angles 104 extend between parallel spaced sides of the frame 100. The foregoing construction is utilized to form two separable sections 106 and 108 of the grate assembly 98. An operating link is adapted to be pivotally connected to the front section 106 of the grate assembly as shown by dotted line in FIG. 11 through which vibration may be imparted to the grate assembly. The grate assembly may be supported on the same U-shaped bearings 88 as shown in FIG. 3. When vibrated, the residue or ash collected on the grate assembly 98 will be guided downwardly by means of the ash slides 110 into the ash collection pan 96.

The two sections 106 and 108 of the grate assembly 98 are coupled to each other and held in co-planar relationship by means of a locking device consisting of a bar 112 projecting from the rear section 108 in overlapping relationship to the front section 106 below the grid 102. A notch 114 is formed in the overlapping portion of the bar 112 and receives a pin 116 secured to the front section 106 when coupled to the rear section as shown in FIG. 11. To disassemble the sections of the grate assembly 98, the front section is pivoted upwardly as shown in FIG. 4 in order to uncouple the sections, the front section being then lifted upwardly for removal.

Figure 16:
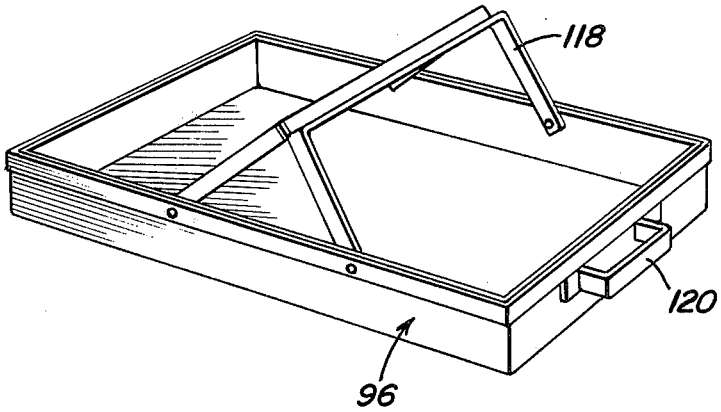
FIG. 16 is a perspective view illustrating the ash collection pan utilized in the furnace.
Figure 15:
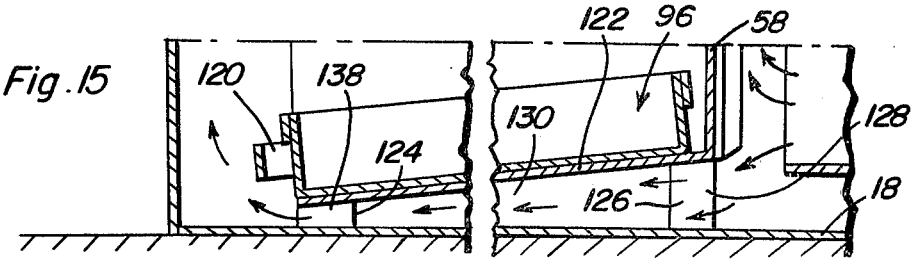
FIG. 15 is an enlarged partial sectional view taken substantially through a plane indicated by section line 15—15 in FIG. 4.

The ash collection pan 96 as more clearly seen in FIG. 16, includes pivoted handles 118 by means of which the pan may be carried once removed from the furnace. A front handle 120 projects from the pan to facilitate its removal from or insertion into the furnace. In the furnace, the ash collection pan 96 is supported on an inclined support 122 that extends between a front bracket 124 and a rear bracket 126 respectively located at the front and rear walls of the heat generator framing the inlet 128 to a bottom passage 130 and the outlet 138 of said passage as more clearly seen in FIG. 15. The support 122 for the ash collection pan 96 thus forms the bottom wall of the heat generator and defines the passage 130 which converges in a downstream direction in order to conduct a forced flow of air from the blower module 22.

As hereinbefore indicated, the heat generator 52 being spaced from the walls of the outer enclosure 12, forms a vertical duct passage 140 between its front wall 14 and the front wall 68 of the heat generator whereas a vertical duct passage 142 is formed between the rear wall 20 of the enclosure and the rear wall 58 of the heat generator as shown in FIG. 2. Also, as shown in FIGS. 3 and 4, vertical duct passages 144 are formed between the side walls 16 of the outer enclosure and the side walls 60 of the heat generator. The bottom passage 130 is in fluid communication with the side ducts 144, with the front duct 140 through outlet 138 and with the rear duct 142 through inlet 128. Inflow of air to the bottom passage 130 and the rear duct passage 142 emerges from the outlet 146 of the centrifugal blower 148 mounted within the blower module 22. The outlet 146 of the blower projects through an opening formed in the rear wall 20 of the enclosure 12, the opening being sealed by a peripheral gasket 150 as shown in FIG. 2. The blower is driven through a drive belt 152 and drive motor 154 as shown in FIG. 4. Thus, a forced inflow of air produced by the blower 148 results in the flow of air upwardly through the rear duct 142 as shown by arrows in FIG. 2 and by forced inflow into the bottom passage 130. A reduced flow of air emerges from the outlet 138 of the bottom of passage 130 for upflow through the front duct passage 140 inasmuch as a varying portion of the air stream within the bottom passage 130 proceeds laterally into the side duct passages 144 because of the convergence of the bottom passage 130 in a downstream direction. As a result of the foregoing duct arrangement, the air flow is metered so that the surface temperature of the heat exchanger is substantially uniform throughout.

The air rising through the vertical duct passages 140, 142 and 144 is preheated by heat exchange with the walls of the heat generator and then absorbs a large quantity of heat by heat transfer within the heat exchanger 32 located above the heat generator within the outer enclosure. As shown in FIGS. 2 and 3, the heat exchanger 32 includes a horizontal conduit 156 having opposite closed ends, and connected adjacent its rear end by means of a flanged inlet 158 to a flanged outlet 160 of the heat generator. The flanged duct sections 158 and 160 extend at an angle of 20° to the vertical to conduct combustion products into the horizontal conduit 156, the combustion products flowing through conduit 156 in a forward direction toward the front wall 14 of the insulated enclosure 12. Adjacent the front end of the enclosure, the conduit 156 is interconnected by a connecting section 162 to a second horizontal conduit 164 through which the combustion products are then conducted rearwardly toward an exhaust outlet 166 as shown in FIG. 2 to which the vertical flue duct is adapted to be connected. Thus, as the combustion products are conducted in reverse directions through the horizontal conduits 156 and 164 of the heat exchanger, heat is absorbed by the vertical upflow of preheated air before the air exits from the upper outlet 26.

As hereinbefore indicated, the fuel burner assembly 40 which is laterally centered on the front wall 14 of the outer enclosure and vertically between the access doors 36 and 38, produces a flame that is confined within the combustion chamber 70 causing ignition of solid fuel centrally therewithin and proceeding rearwardly causing the burning to occur evenly and in the correct direction to minimize consumption of the liquid or gaseous fuel itself. Particularly in connection with the burning of logs, relatively efficient and rapid ignition occurs resulting in the prompt and automatic cessation of operation of the fuel burner under thermostatic control once sufficient combustion of the solid fuel at the requisite rate takes over to maintain the desired heating temperature. The forced and metered flow of air in surrounding relation to the heat exchanger scrubs its entire outer surface then passes in heat transfer relationship to the radiating ducts 156 and 164 of heat exchanger 32 through which tortuous travel of combustion products is effected. The foregoing arrangement provides for both complete combustion of the fuel being burned as well as extraction of the maximum amount of heat therefrom. Cooling of the heat generator by the upflowing air will also minimize the formation of coatings and corrosive emissions by the burning of wood and other such solid fuels.

Figure 5:
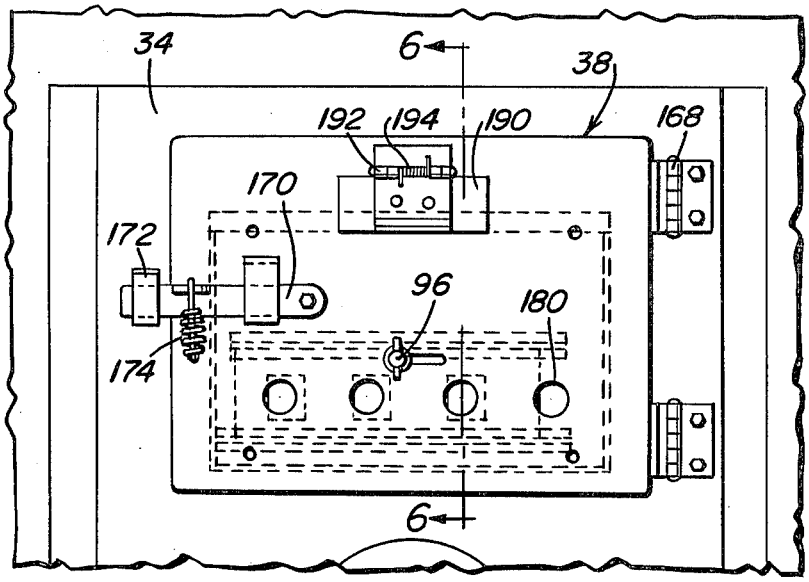
FIG. 5 is a front elevational view of the feed access door associated with the furnace.
Figure 6:
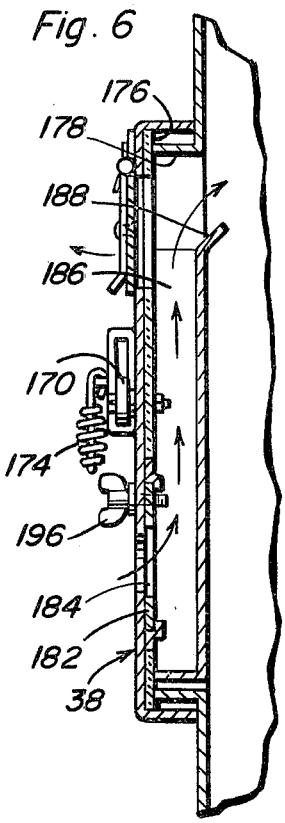
FIG. 6 is a partial sectional view taken substantially through a plane indicated by section line 6—6 in FIG. 5.

The heating plant may be readily serviced by means of the separate doors 36 and 38 aforementioned. As more clearly seen in FIGS. 5 and 6, the feed door 38 is mounted on the panel 34 by means of a pair of hinges 168. The door is adapted to be held closed by means of a latch bar 170 pivotally mounted on the door and adapted to be received in a catch 172 secured to the panel 34. The latch may be pivoted upwardly to release the door by means of a handle 174. A sealing gasket 176 peripherally lines the door to seal the opening 178.

A plurality of air inlet holes 180 are formed in the door in order to conduct an inflow of air for cooling the same. A primary purpose, however, for the inflow of secondary air through the feed door is to enhance the complete combustion of the primary solid fuel. This is particularly important for the burning of wood as the primary fuel in order to reduce the amount of creosote which is otherwise deposited on all contact surfaces of the combustion chamber and the chimney. The amount of air inflow is controlled by means of a control slide 182 having openings 184 adapted to be positioned in adjusted relation to the openings 180 in the door to meter the inflow of secondary air. The control slide 182 is held in an adjusted position by a wing nut lock 196. The inflow of air is conducted through a passage 186 to the outlet 188 opening into the interior of the enclosure. A smaller relief door 190 is pivotally mounted by a hinge 192 on the feed door and is biased to a closed position by a hinge mounted spring 194. The primary function of the feed door itself is, of course, to permit the loading of solid fuel into the combustion chamber.

Figure 7:
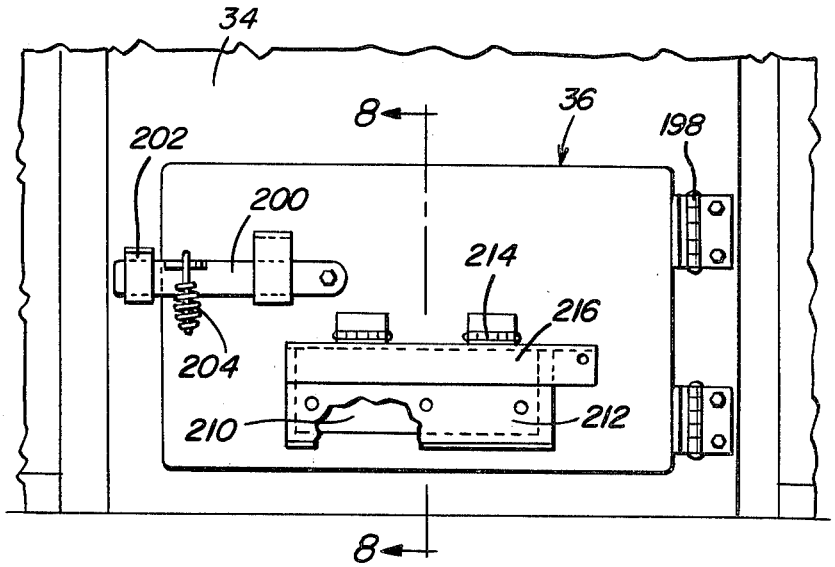
FIG. 7 is a front elevational view of the ash pit access door associated with the furnace.
Figure 8:
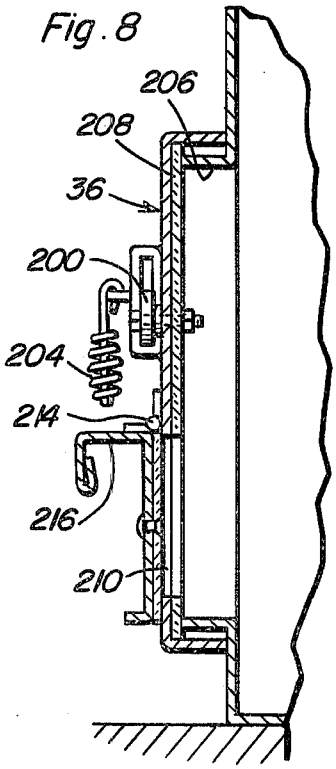
FIG. 8 is a partial sectional view taken substantially through a plane indicated by section line 8—8 in FIG. 7.
Figure 14:
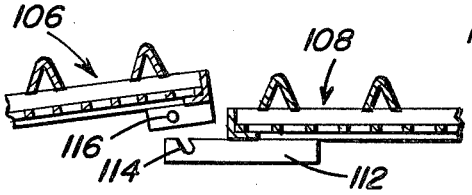
FIG. 14 is a partial side sectional view similar to FIG. 11 but showing the grate assembly being disassembled.

Access to the ash collection pan 96 is provided by the ash pit door 36 which is mounted vertically below the burner assembly as aforementioned. As more clearly seen in FIGS. 7 and 8, the ash pit door 36 is pivotally mounted on the panel 34 by the spaced hinges 198 and like the feed door 38 is provided with a pivoted latch door 200 adapted to be received within a catch 202 and pivotally lifted upwardly therefrom by means of a handle 204 in order to open the door. The door is sealed against the opening 206 by a sealing gasket 208. A draft opening 210 is formed in the door and is adapted to be closed by a draft door 212 supported by a pair of spaced hinges 214. A counterweight 216, is connected to the draft door 212 in order to gravitationally bias it to the closed position shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-fuel heating furnace comprising, an insulating enclosure having spaced vertical walls and a base, a heat generator mounted within said enclosure in spaced relation to the vertical walls having a combustion chamber therein, a grate assembly supported within the heat generator below the combustion chamber for supporting solid fuel, fluid fuel burner means mounted on the enclosure for igniting the solid fuel on the grate assembly, heat exchanger means mounted within the enclosure above the heat generator for conducting air in heat transfer relation to combustion products from the heat generator, and blower means connected to the enclosure for inducing a forced inflow of air to the heat exchanger means.

2. The combination of claim 1 including ducted means formed in the enclosure for conducting the air from the blower means in heat exchange relation to the combustion chamber of the heat generator.

3. The combination of claim 2 wherein said ducted means includes an inlet opening formed in one of the vertical walls communicating with said blower means below the combustion chamber, vertical passages formed about the heat generator within the enclosure, and converging passage means extending from said inlet opening below the combustion chamber toward one of said vertical passages for effecting substantially uniform heat exchange through the vertical passages.

4. The combination of claim 3 including a residue collector, support means mounted in spaced relation above the base to form converging passage means and to removably hold the residue collector in operative alignment below the grate assembly.

5. The combination of claim 4 including separate access means mounted on the enclosure through which the solid fuel is loaded into the combustion chamber and the residue collector removed, respectively.

6. The combination of claim 5 wherein said one of the vertical passages is formed between the heat generator and one of the vertical walls remote from the blower means, the fluid fuel burner means and the access means being mounted on said one of the vertical walls.

7. The combination of claim 6 wherein said heat exchanger means includes at least two horizontal conduits through which the combustion products are conducted in reverse directions transversely of the vertical passages.

8. The combination of claim 7 wherein said grate assembly includes at least two separable sections, and releasable coupling means for holding the separable sections in planar relation to each other while permitting uncoupling in response to upward pivotal displacement of the sections relative to each other.

9. The combination of claimm 1 including a residue collector, support means mounted in spaced relation above the base to removably hold the residue collector in operative alignment below the grate assembly.

10. The combination of claim 9 including separate access means mounted on the enclosure through which the solid fuel is loaded into the combustion chamber and the residue collector removed, respectively.

11. The combination of claim 10 wherein said fluid fuel burner means includes a firing tube projecting from the enclosure into the combustion chamber.

12. The combination of claim 11 including separate access means mounted on the enclosure above and below the fluid fuel burner means through which the solid fuel is loaded into the combustion chamber and the residue collector removed, respectively.

13. The combination of claim 9 including access means mounted on the enclosure above and below the fluid fuel burner means through with the solid fuel is loaded into the combustion chamber and the residue collector removed, respectively.

14. The combination of claim 1 wherein said grate assembly includes at least two separable sections, and releasable coupling means for holding the separable sections in planar relation to each other while permitting uncoupling in response to upward pivotal displacement of the sections relative to each other.

15. The combination of claim 11 wherein said fluid fuel burner means includes a firing tube projecting from the enclosure into the combustion chamber.

16. The combination of claim 1 including a residue collector positioned within the enclosure below the grate assembly, and separate access means mounted on the enclosure through which the solid fuel is loaded into the combustion chamber and the residue collector removed, respectively.

17. The combination claim 16 wherein said burner means is mounted on the enclosure vertically between said separate access means and includes a firing tube projecting into the combustion chamber from which a flame issues across the grate assembly toward the blower means.

18. The combination of claim 1 including an access door mounted on the enclosure through which the solid fuel is loaded onto the grate assembly, and adjustable means mounted on the door for conducting a regulated inflow of secondary air into the combustion chamber to enhance complete combustion of the solid fuel.

19. The combination of claim 18 wherein said solid fuel includes wood.

20. A heating furnace comprising, an insulating enclosure having spaced vertical walls and a base, a heat generator mounted within said enclosure in spaced relation to the vertical walls to form vertical passages thereabout, heat exchanger means mounted within the enclosure above the heat generator for conducting air in heat transfer relation to combustion products from the heat generator, blower means connected to the enclosure for inducing a forced inflow of air to the heat exchanger means, and ducted means formed in the enclosure for conducting the air from the blower means through said vertical passages in heat exchange relation to the heat generator, said ducted means including inlet means formed in one of the vertical walls and opening into one of said vertical passages for discharging air from said blower means below the heat generator, said vertical passages being formed about the heat generator within the enclosure in transverse relation to said discharge of air through the inlet means, and converging passage means extending transversely of said vertical passages from said inlet means below the heat generator for conducting air into another of said vertical passages remotely spaced from the blower means to effect substantially uniform heat exchange through the vertical passages.

21. The combination of claim 20 wherein said heat exchanger means includes at least two horizontal conduits through which the combustion products are conducted in reverse directions transversely of the vertical passages.

* * * * *